US006806427B2

(12) United States Patent
Kadotani et al.

(10) Patent No.: US 6,806,427 B2
(45) Date of Patent: Oct. 19, 2004

(54) TRANSPARENT PROTECTIVE TUBE FOR EXTERNAL CABLE

(75) Inventors: Tsutomu Kadotani, Atsugi (JP); Toshikazu Minami, Amagasaki (JP); Shoji Shirahama, Amagasaki (JP); Tetsuya Inagake, Kakegawa (JP); Seishi Suzuki, Kakegawa (JP)

(73) Assignees: Anderson Technology Corporation, Tokyo (JP); Shinko Wire Company, Hyogo (JP); Tigers Polymer Corporation, Osaka (JP)

( * ) Notice: Subject to any disclaimer, the term of this patent is extended or adjusted under 35 U.S.C. 154(b) by 0 days.

(21) Appl. No.: 10/399,154

(22) PCT Filed: Jul. 30, 2002

(86) PCT No.: PCT/JP02/07731

§ 371 (c)(1),
(2), (4) Date: Jun. 9, 2003

(87) PCT Pub. No.: WO03/038190

PCT Pub. Date: May 8, 2003

(65) Prior Publication Data

US 2004/0020679 A1 Feb. 5, 2004

(51) Int. Cl.[7] ..... H01B 7/00

(52) U.S. Cl. ..... 174/70 C; 174/70 R; 174/68.1; 174/98

(58) Field of Search ..... 174/70 C, 70 R, 174/68.1, 98

(56) References Cited

U.S. PATENT DOCUMENTS 4,407,893 A * 10/1983 Malizio ..... 428/454
6,489,420 B1 * 12/2002 Duchesne et al. ..... 526/255

FOREIGN PATENT DOCUMENTS

JP 01122312 A * 5/1989 ..... H02G/3/04

OTHER PUBLICATIONS

English Abstract for JP01122312.*

* cited by examiner

*Primary Examiner*—Dean A. Reichard
*Assistant Examiner*—Jinhee Lee
(74) *Attorney, Agent, or Firm*—Lord, Bissell & Brook LLP; James H. Wynn; Roberta L. Hastreiter

(57) ABSTRACT

A cable protecting tube having high transparency and allowing the filling condition of mortar therein to be visually observed from the outside as well as exhibiting high pressure resistance is provided.

A cable protecting tube for accommodating a cable and for filling with mortar includes a protecting tube (1) having smooth inner and outer surfaces formed from an ionomer resin excellent in transparency, and a spiral or mesh-shaped reinforcing member (2) for reinforcing the protecting tube. The reinforcing member (2) may be buried in the protecting tube (1). The protecting tube (1) is not limited to the smooth-walled tube but may be a spirally corrugated tube.

5 Claims, 4 Drawing Sheets

TRANSPARENT PROTECTIVE TUBE FOR EXTERNAL CABLE

TECHNICAL FIELD

The present invention relates to a protecting tube for external cable applicable to a bridge or the like. More particularly, the present invention relates to a transparent protecting tube for external cable that is adapted to accommodate a tendon for prestressed concrete (hereinafter occasionally referred to simply as "tendon") and filled with a filler.

BACKGROUND ART

External cables used for bridges or the like generally use protecting tubes for accommodating tendons. In such a protecting tube for external cable, a filler is tightly filled around the tendon accommodated therein, thereby preventing corrosion of the tendon.

Thus, the protecting tube for external cable needs to be filled tightly with a filler. Therefore, it is preferable that the protecting tube should allow visual observation of the filling condition of the filler. In addition, the protecting tube needs to withstand the filling pressure of the filler.

Japanese Patent Application Unexamined Publication (KOKAI) No. 2000-320071 discloses a tendon-protecting synthetic resin tube which is a transparent synthetic resin tube adapted to contain a tendon and filled with a filler. The synthetic resin tube has a flexible portion and a rigid portion that are formed from a polyvinyl chloride resin. The flexible portion is made of a polyvinyl chloride resin containing from 20 to 40 parts of a plasticizer. This document states that the synthetic resin tube is formed by spirally winding a belt-shaped flexible synthetic resin material in the longitudinal direction of the tube, the belt-shaped flexible synthetic resin material containing the rigid portion as a core material. It is also stated that the tendon is made up of prestressing steel wires or steel strands and used as a tendon for external-cable post-tensioning system.

In this synthetic resin tube, however, the plasticizer contained in the flexible portion in a large quantity migrates and causes the degree of flexibility to lower as time elapses. Moreover, because the synthetic resin tube uses a polyvinyl chloride resin, which is readily deteriorated by ultraviolet radiation or the like, it is difficult to increase durability. It is also feared that dioxin may be generated.

Japanese Patent Application Unexamined Publication (KOKAI) No. Hei 9-144210 discloses a protecting tube for covering and protecting tendons, such as prestressing steel wires, steel strands or steel bars, used for prestressed concrete. The protecting tube has spirally corrugated inner and outer surfaces, and the whole of the tube is formed from a polyolefin resin material. The use of a high-density polyethylene resin is also stated in this document.

However, the tube which is spirally corrugated on both faces (i.e. protecting tube for a tendon, inner and outer surfaces of which are both spirally corrugated) exhibits low pressure resistance in the radial direction when it is filled with a filler. Moreover, the transparency of the tube lowers. Therefore, the filling condition of the filler in the tube cannot visually be confirmed with high accuracy.

Japanese Patent Application Unexamined Publication (KOKAI) No. Hei 6-55636 discloses a cross-linked tube formed from a resin composition consisting essentially of an ionomer resin. The ionomer resin contains from 0 to 50 parts by weight of an ionomer resin in which the molecules of a copolymer of ethylene with (meth)acrylic acid have been crosslinked with sodium ions or/and zinc ions with respect to 100 parts of an ionomer resin in which the molecules of a copolymer of ethylene with (meth)acrylic acid have been crosslinked with potassium ions. The crosslinked tube is obtained by a method wherein the resin material is formed into a tube-like shape from an extruder and thereafter irradiated with an electron beam. The crosslinked tube is free from Lichtenberg discharge marks. This document also states that an adhesive or pressure-sensitive adhesive layer of an ethylene-ethyl acrylate-carbon monoxide copolymer is formed on the inner surface of the crosslinked tube.

However, because crosslinking is irreversibly effected by electron beam irradiation, the ionomer resin material cannot be reused. Moreover, it is difficult to improve pressure resistance.

Accordingly, an object of the present invention is to provide a cable protecting tube having high transparency and allowing the filling condition of a filler therein to be visually observed from the outside as well as exhibiting high pressure resistance.

Another object of the present invention is to provide a cable protecting tube that is excellent in low-temperature resistance, flexibility and durability and useful for accommodating a tendon and for filling with a filler to obtain an external cable.

DISCLOSURE OF INVENTION

As the result of conducting exhaustive studies, the present inventors found that the above-described problem can be solved by forming the cable protecting tube from an ionomer resin and reinforcing it, and made the present invention on the basis of this finding.

That is, the transparent protecting tube for external cable (hereinafter occasionally referred to simply as "protecting tube") according to the present invention is a transparent synthetic resin tube for accommodating a tendon and for filling with a filler. The transparent synthetic resin tube comprises a protecting tube formed from an ionomer resin and a spiral or mesh-shaped reinforcing member for reinforcing the protecting tube.

In the protecting tube, the reinforcing member may be buried in the protecting tube. The protecting tube may be a spirally corrugated tube, a smooth-walled tube, etc.

The transparent protecting tube for external cable may be formed from a resin material or a resin composition containing at least 30% by weight of an ionomer resin in which a part or whole of the carboxyl groups of an ethylene-unsaturated carboxylic acid copolymer have been neutralized with metal ions or ammonium ions.

In addition, the present invention includes a resin material or a resin composition for use in a transparent protecting tube for external cable. The resin material or the resin composition contains at least 30% by weight of an ionomer resin in which a part or whole of the carboxyl groups of an ethylene-unsaturated carboxylic acid copolymer have been neutralized with metal ions or ammonium ions.

EXPLANATION OF REFERENCE NUMERALS

Figure 1:
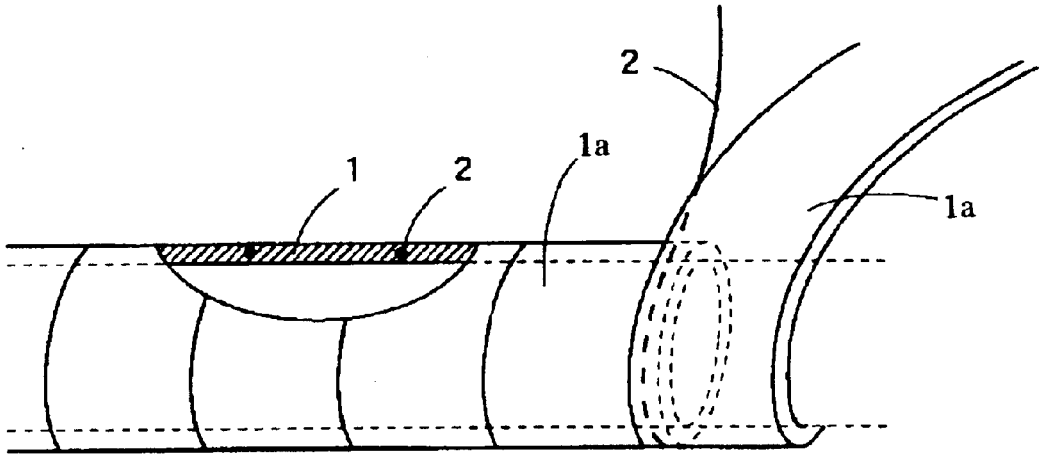
FIG. 1 is a partially-cutaway schematic view showing an example of a transparent protecting tube for external cable and a production method therefor.

1 . . . cable protecting tube
1*a* . . . tape-shaped ionomer resin
1*b* . . . inner resin layer
1*c* . . . outer resin layer
2 . . . reinforcing member (first reinforcing member)
3*a* . . . outer-wall resin layer
3*b* . . . inner-wall resin layer
4 . . . second reinforcing member
11 . . . corrugator
11*a* . . . die of corrugator
12 . . . reinforcing member feeder
13 . . . tube die

BEST MODE FOR CARRYING OUT THE INVENTION

The present invention will be described below in detail with reference to the accompanying drawings as occasion demands.

The ionomer resin forming the transparent protecting tube for external cable according to the present invention is defined as an ion-crosslinked resin in which the carboxyl groups of an ethylene-unsaturated carboxylic acid copolymer have been partially neutralized with cations such as metal ions or ammonium ions.

The properties of such an ionomer resin vary according to the molecular weight, the carboxyl group concentration of the base polymer, the species of metal ions, the degree of neutralization, etc. However, the ionomer resin is generally characterized by high transparency and excellent moldability, impact resilience, flexibility, impact resistance and low-temperature resistance as well as high toughness.

The ethylene-unsaturated carboxylic acid copolymer used as a base polymer in the above-described ionomer resin is a resin in which the proportion of the ethylene component to the unsaturated carboxylic acid component is from 80/20 to 99/1 (mole %), preferably from 85/15 to 98/2 (mole %), particularly preferably from 90/10 to 98/2 (mole %). In addition to the ethylene component and the unsaturated carboxylic acid component, another unsaturated monomer component may be copolymerized in the proportion of from 0 to 20 mole %, preferably from 0 to 15 mole %.

It is also possible to use two or more different kinds of unsaturated carboxylic acid components as long as the sum total satisfies the above-described condition. Further, a mixture of two or more different ethylene-unsaturated carboxylic acid copolymers, which are different in the kind of unsaturated carboxylic acid component, may be used as the base polymer in the present invention.

Examples of unsaturated carboxylic acid components are acrylic acid, methacrylic acid, ethacrylic acid, fumaric acid, maleic acid, monoalkyl maleate (e.g. monomethyl maleate and monoethyl maleate), and maleic anhydride. These unsaturated carboxylic acid components can be used either singly or in combination of two or more of them. It is particularly preferable to use acrylic acid or methacrylic acid.

Examples of other unsaturated monomer components usable are acrylates and methacrylates such as methyl (meth)acrylate, ethyl (meth)acrylate, isobutyl (meth) acrylate, and n-butyl (meth)acrylate, vinyl esters such as vinyl acetate, styrene monomers such as styrene, butadiene, halogen-containing monomers such as vinyl chloride and tetrafluoroethylene, and silane compounds.

Examples of metal ion species usable in the ethylene-unsaturated carboxylic acid copolymer ionomer are alkaline metals such as lithium, sodium and potassium, alkaline earth metals such as magnesium, calcium and barium, and transition metals such as zinc, copper, manganese, cobalt and aluminum.

These metal ion species can be used either singly or in combination of with two or more of them. Preferred metal ion species are lithium, sodium, magnesium, zinc, etc. From the viewpoint of both the resistance to the heat generated during as the filler hardening and of the resistance to the internal pressure, an ionomer resin neutralized with magnesium ions is the most favorable.

The degree of neutralization by the metal ions is not particularly limited but may be not less than 20%, preferably about 30 to 95% in terms of the average degree of neutralization.

The melt flow rate (MFR) of the above-described ionomer resin is 0.01 to 50 g/10 min., preferably 0.05 to 15 g/10 min., particularly preferably 0.1 to 5 g/10 min., at a temperature of 190° C. and a load of 2160 g.

The ionomer resin may be melt-kneaded with another synthetic resin or the like as a constituent material for the transparent protecting tube according to the present invention as long as the added material does not impair characteristics of the ionomer resin that are important in the use application of the present invention, such as transparency, impact resistance, low-temperature resistance, and toughness. Examples of such synthetic resins are polyolefins such as high-density polyethylene, medium-density polyethylene, low-density polyethylene, polypropylene, ethylene-(meth) acrylic acid copolymer, ethylene-(meth)acrylate copolymer, and ethylene-vinyl acetate copolymer, polyamides such as nylon 6, nylon 66, nylon 11 and nylon 12, polyesters such as polyethylene terephthalate (PET), and polybutylene terephthalate (PBT), polystyrene resins such as general-purpose polystyrene (GPPS), high-impact polystyrene (HIPS), ABS resin, and acrylonitrile-styrene copolymer (AS resin), polycarbonate, polymethyl methacrylate (PMMA), and various thermoplastic elastomers.

These synthetic resins may be used either singly or in combination of two or more of them by being melt-kneaded with the ionomer resin. The weight ratio of the ionomer resin in such a mixture is not less than 30% by weight, preferably not less than 50% by weight.

If necessary, additives used in common practice, e.g. stabilizers (heat stabilizer, chelator, anti-oxidant, and ultraviolet absorber), fire retardant, antistatic agent, coloring agent, and lubricant, may be added to the ionomer resin.

The reinforcing member (reinforcing thread) can be formed from metal wire, rigid resin, fiber (inorganic fiber or organic fiber), etc. Examples of rigid resins usable are rigid thermoplastic resins such as polyester resins. Examples of organic fibers usable are acrylic fiber, nylon fiber, and polyester fiber. Examples of inorganic fibers usable are glass fiber, silica fiber, alumina fiber, ceramic fiber, metal fiber (e.g. steel fiber or stainless steel fiber), and carbon fiber. These fibers can be used either singly or in combination of two or more of them. Preferred fibers are inorganic fibers such as glass fiber, and organic fibers such as acrylic fiber, nylon fiber, and polyester fiber. The reinforcing member (reinforcing thread) can be usually used in the form of cord produced by twisting fibers such as polyester fibers (e.g. in the form of cord of 1000 to 50000 denier, preferably 2000 to 25000 denier).

As shown in FIG. 1, the protecting tube for external cable according to the present invention comprises a hollow smooth transparent tube (i.e. a hollow tube with smooth inner and outer surfaces) 1 formed from an ionomer resin and a spiral or mesh-shaped reinforcing member (or reinforcing thread) 2 buried in the wall of the transparent tube so as to be integrated therewith. This protecting tube has not only high transparency but also high pressure resistance offered by the reinforcing thread 2. Therefore, even when the hollow transparent tube 1 is filled with a filler after the tendon has been accommodated therein, the filling condition of the filler can surely be observed from the outside, and the filler can be filled smoothly.

The wall thickness d of the protecting tube may be, for example, of the order of from 15 to 35 mm, preferably from 20 to 30 mm, more preferably from 22 to 28 mm. The average inner diameter D1 may be, for example, of the order of from 30 to 150 mm, preferably from 55 to 125 mm, more preferably from 75 to 105 mm. When the protecting tube has a spiral form, the proportion of the tube inner diameter D1 at the crest inner surface to the tube inner diameter D2 at the root inner surface (D1/D2) may be, for example, of the order of from 1.1 to 1.5.

The protecting tube can be produced, as shown in FIG. 1, by extruding an ionomer resin in the form of tape from an extruder and spirally winding the ionomer resin tape around the tubing axis in such a manner that the side edges of each pair of adjacent turns of tape 1*a* are butted against each other with a reinforcing member or reinforcing thread 2 sandwiched between the side edges (butted portions) of the adjacent turns of tape 1*a*. This production method allows the protecting tube to be formed continuously with low-cost production facilities and also makes it possible to form a protecting tube of unfixed length. Accordingly, protecting tubes of continuous length can be obtained efficiently.

It should be noted that the width of the tape (i.e. the pitch p of the spiral resin tube body) is usually of the order of from 10 to 200 mm, preferably from 20 to 100 mm, more preferably from 30 to 80 mm. The pitch of the reinforcing member or the reinforcing thread may be, for example, of the order from 3 to 50 mm, preferably from 5 to 30 mm, more preferably from 5 to 20 mm.

A protecting tube having the above-described structure may be formed by winding tape prepared by extruding an ionomer resin in the form of tape from an extruder and burying a reinforcing thread in the ionomer resin tape. It should be noted that tape with a reinforcing thread buried or enclosed therein may be formed by sandwiching the reinforcing thread between a plurality of tape-shaped melts. When the reinforcing member is a rigid resin, a protecting tube may be prepared by extruding the reinforcing resin in a line form and, at the same time, extruding an ionomer resin around the linearly extruded resin from a die. Further, a protecting tube may be prepared by winding a reinforcing member, e.g. a metal wire, around a transparent tube and, if necessary, bonding the reinforcing member to the tube.

It should be noted that the protecting tube does not always need to be a tube with a single-layer structure but may have a laminated structure comprising a plurality of layers. In such a laminated structure, the reinforcing member may be interposed between each pair of adjacent resin layers.

Figure 2:
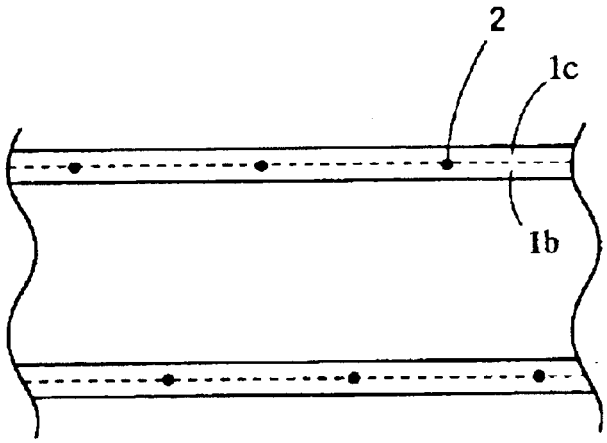
FIG. 2 is a schematic view showing another example of the transparent protecting tube for external cable.

As shown in FIG. 2, by way of example, a protecting tube may comprise a smooth inner resin layer 1*b* formed from the above-described ionomer resin; a reinforcing member (or a reinforcing thread) 2 wound on the outer surface of the inner resin layer 1*b* at a predetermined pitch; and a smooth outer resin layer 1*c* formed from an ionomer resin and fusion-laminated over the inner resin layer 1*b* and the reinforcing member 2.

Figure 3:
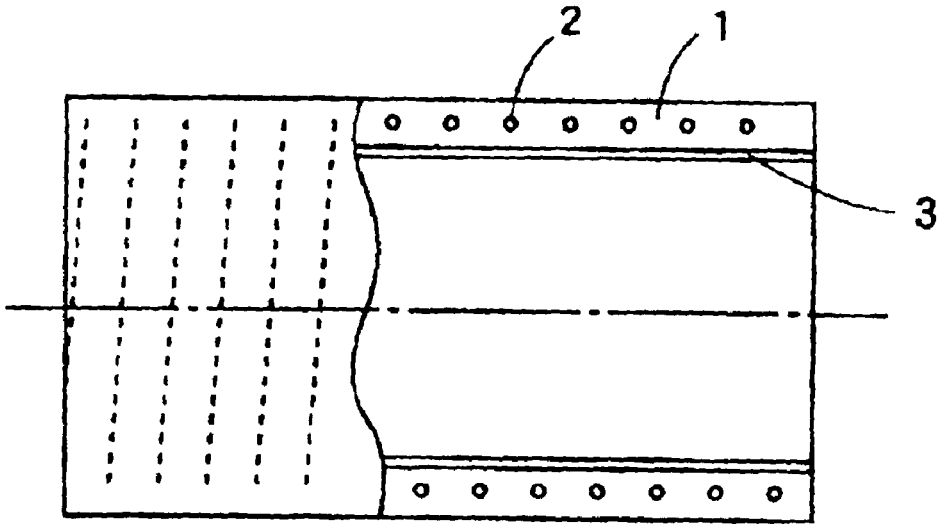
FIG. 3 is a partially-sectioned schematic view showing still another example of the transparent protecting tube for external cable.
Figure 4:
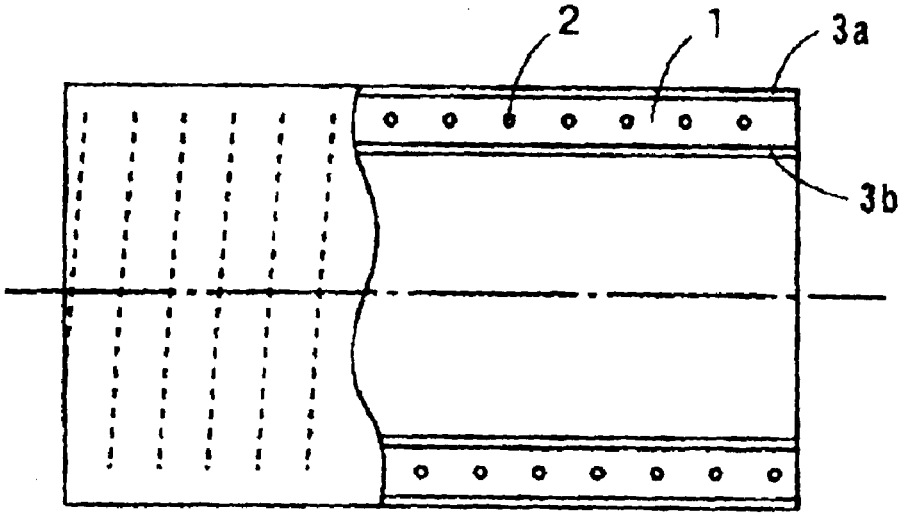
FIG. 4 is a partially-sectioned schematic view showing a further example of the transparent protecting tube for external cable.

In addition, a resin layer may be formed on the wall surface of at least either one of the inner and outer walls of the protecting tube. FIG. 3 is a partially-sectioned schematic view showing still another example of the protecting tube according to the present invention. FIG. 4 is a partially-sectioned schematic view showing a further example of the protecting tube according to the present invention.

The protecting tube shown in FIG. 3 comprises a hollow smooth transparent tube (i.e. a hollow tube with smooth inner and outer surfaces) 1 formed from an ionomer resin and a spiral or mesh-shaped reinforcing member (or reinforcing thread) 2 buried in the wall of the transparent tube in the same way as the protecting tube shown in FIG. 1. An inner-wall resin layer 3 of an ionomer resin is formed on the inner wall of the transparent tube 1. It should be noted that the transparent tube 1 is formed from an ionomer resin of high transparency, and the inner-wall resin layer 3 is formed from an ionomer resin having high heat resistance and high rigidity as well as transparency.

In the example shown in FIG. 4, the protecting tube comprises a hollow smooth transparent tube (i.e. a hollow tube with smooth inner and outer surfaces) 1 formed from an ionomer resin and a spiral or mesh-shaped reinforcing member (or reinforcing thread) 2 buried in the wall of the transparent tube. An outer-wall resin layer 3*a* and an inner-wall resin layer 3*b*, each of which is formed from an ionomer resin, are laminated on the outer and inner walls, respectively, of the protecting tube. It should be noted that the transparent tube 1 is formed from an ionomer resin of high transparency, and the outer- and inner-wall resin layers 3*a* and 3*b* are formed from an ionomer resin having high heat resistance and high rigidity as well as transparency.

It should be noted that the reinforcing member does not always need to be buried in the protecting tube but is only required to reinforce the protecting tube. The reinforcing member may be integrated with the inner-wall resin layer and/or the outer-wall resin layer by being buried therein.

Figure 5:
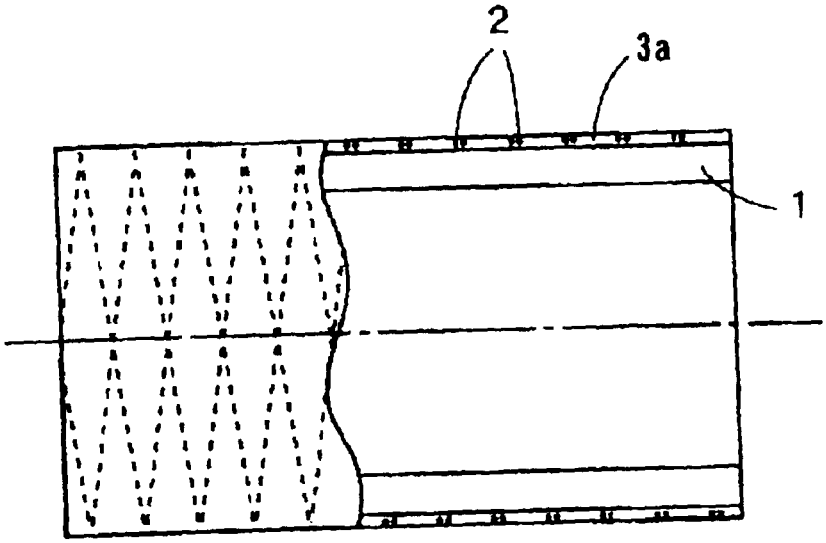
FIG. 5 is a partially-sectioned schematic view showing an example of another transparent protecting tube for external cable.

FIG. 5 is a partially-sectioned schematic view showing an example of another protecting tube according to the present invention.

In this example, the protecting tube comprises a hollow smooth transparent tube (i.e. a hollow tube with smooth inner and outer surfaces) 1 formed from an ionomer resin; a resin layer (in this example, an outer-wall resin layer 3*a*) formed or laminated on the wall surface of at least either one of the inner and outer walls of the transparent tube; and a spiral or mesh-shaped reinforcing member (or reinforcing thread) 2 buried in the resin layer 3*a*. It should be noted that the transparent tube 1 is formed from an ionomer resin of high transparency, and the resin layer (outer-wall resin layer 3*a*) is formed from an ionomer resin having high heat resistance and high rigidity as well as transparency. The reinforcing member 2 is formed from a plurality of elongated reinforcing members adjacent to each other.

Figure 6:
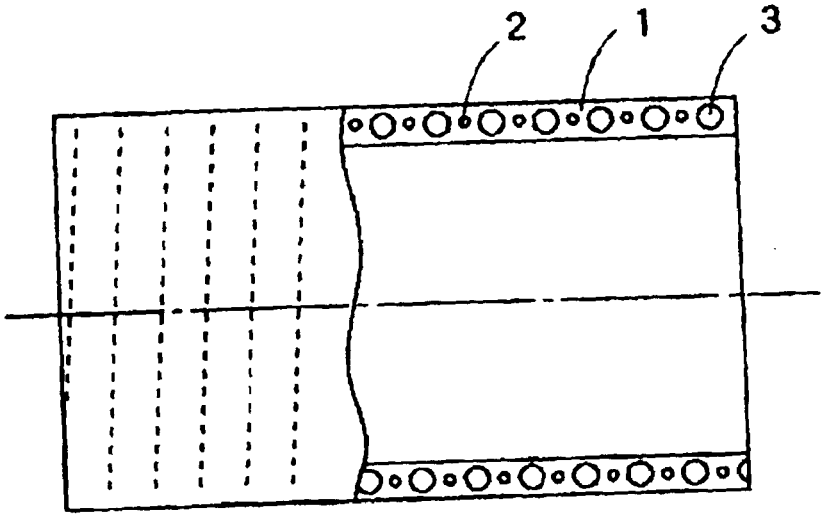
FIG. 6 is a partially-sectioned schematic view showing an example of still another transparent protecting tube for external cable.

The protecting tube may be reinforced with a plurality of reinforcing members. FIG. 6 is a partially-sectioned schematic view showing an example of still another protecting tube according to the present invention. In this example, the protecting tube comprises a hollow smooth transparent tube (i.e. a hollow tube with smooth inner and outer surfaces) 1 formed from an ionomer resin, and a first reinforcing member 2 and a second reinforcing member 4 that are spirally buried in the transparent tube adjacently to each other. The first reinforcing member 2 can be formed from either an inorganic reinforcing material, e.g. metal wire or glass fiber, or an organic reinforcing material, e.g. organic fiber. The second reinforcing member 4 can be formed from a resin of high rigidity (e.g. an ionomer resin of high heat resistance and high rigidity).

It should be noted that the constituent material used to form the inner- and outer-wall resin layers and the second reinforcing member is not necessarily limited to an ionomer resin but may be any resin material selected from among olefin resins (e.g. polyethylene resins such as high-density polyethylene and linear low-density polyethylene, and polypropylene resins), polyester resins, and polyamide resins. Further, the first reinforcing member formed from a reinforcing thread or the like may be replaced with the second reinforcing member (e.g. an ionomer resin of high rigidity, or a polyolefin resin).

Figure 7:
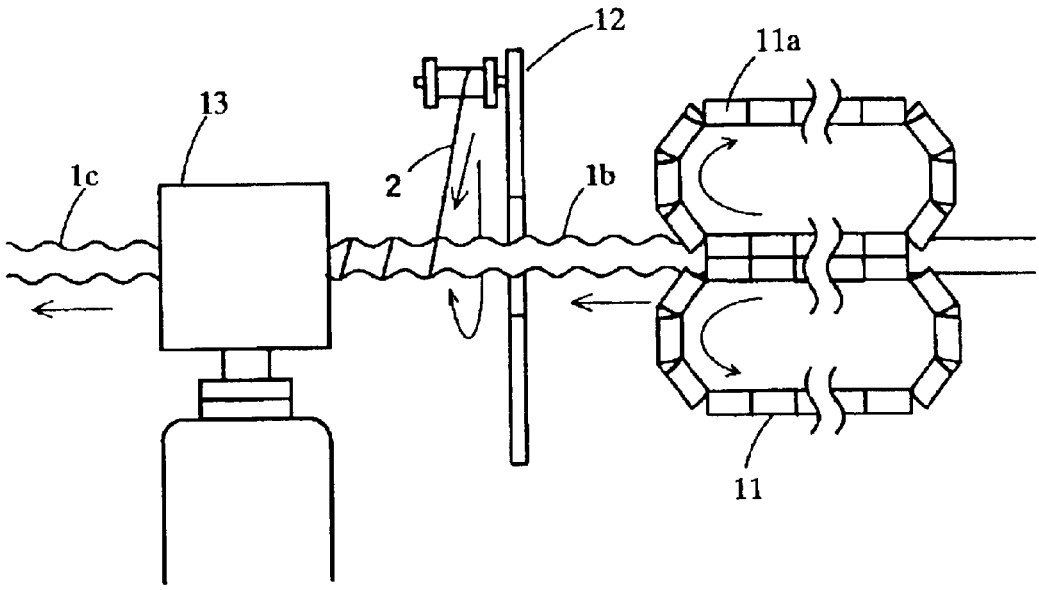
FIG. 7 is a schematic view showing a method of producing a corrugated transparent protecting tube for external cable.

The protecting tube is not necessarily limited to the above-described smooth-walled tube with smooth inner and outer surfaces but may be a corrugated tube. A corrugated protecting tube may be produced as shown in FIG. 7, by way of example. A corrugated tube-shaped inner resin layer 1*b* is formed by continuous blowing using a corrugator 11. The outer surface of the corrugated tube-shaped inner resin layer 1*b* is wound with a reinforcing member 2 supplied from a reinforcing member feeder 12. Further, the outer surface of the inner resin layer 1*b* is covered or laminated with an outer resin layer 1*c* by a tube die 13.

It should be noted that the corrugator 11 has two circulating paths that circulate in a loop shape and face each other to form a forming area. The corrugator 11 further has a plurality of pairs of forming members that constitute die members 11*a* capable of forming a resin parison extruded from an extruder into a spirally corrugated configuration.

In the above-described corrugator, the forming members, which are circulatably disposed in the two circulating paths to constitute a plurality of forming members, join together at the starting end of the forming area and constitute a forming section from a plurality of die members 11*a* in the forming area. The joined forming members separate from each other at the terminating end of the forming area and then circulate along the respective circulating paths. Consequently, the resin parison is continuously corrugated while advancing through the forming area.

The reinforcing member feeder 12 has a feed unit capable of delivering a reinforcing member or a reinforcing thread while stretching it under a moderate tension. Moreover, the reinforcing member feeder 12 can rotate about the inner resin layer 1*b* as a center axis. Therefore, as the reinforcing member feeder 12 rotates, the reinforcing member or the reinforcing thread can be spirally wound on the outer periphery of the resin parison corrugated as it advances. The tube die 13 has a corrugation portion that allows the inner resin layer 1*b* wound with the reinforcing member 2 to pass therethrough, and forms an outer resin layer 1*c* over the outer surface of the inner resin layer 1*b* and that of the reinforcing member 2.

In the protecting tube having such a laminated structure, the outer resin layer 1*c* and the inner resin layer 1*b* are only required to retain the reinforcing member to such an extent that the reinforcing member will not become displaced. Therefore, the outer resin layer 1*c* and the inner resin layer 1*b* may be made of different materials that do not bond or fusion-bond to each other. However, it is preferable to form the outer resin layer 1*c* and the inner resin layer 1*b* from the same material or respective materials derived from the same kind of resin material. For example, it is possible to form either of the outer resin layer and the inner resin layer from an ionomer resin and the other layer from a transparent resin [e.g. polyethylene resins such as ethylene-(meth)acrylate copolymer and ethylene-vinyl acetate copolymer, polypropylene resins, and polyesters]. However, it is preferable to form the two layers from the same ionomer resin or different kinds of ionomer resins.

It should be noted that the above-described cable protecting tube may have such a structure that either or both of the inner and outer surfaces thereof are smooth or curved (or bent). In general, however, the cable protecting tube is preferably a smooth-walled tube with smooth inner and outer surfaces as shown in FIG. 1.

The reinforcing member or the reinforcing thread is only required to be capable of reinforcing the protecting tube and may be spirally formed at a predetermined pitch with respect to the longitudinal direction of the protecting tube. Alternatively, the reinforcing member or the reinforcing thread may be disposed to cross at a predetermined pitch. Although in the foregoing example the reinforcing member 2 is buried in the protecting tube 1 or in the resin layer 3*a*, the reinforcing member or the reinforcing thread may be spirally formed on the inner or outer surface of the protecting tube or the resin layer and integrated with the protecting tube.

For example, the reinforcing member may be spirally wound on the outer surface of the protecting tube and integrated therewith, for example, by impregnation, bonding or fusion bonding. Further, the reinforcing member or the reinforcing thread in the protecting tube is not necessarily limited to a single reinforcing member or reinforcing thread but may, for example, be a double-pitch or triple-pitch reinforcing member that comprises a plurality of reinforcing members or reinforcing threads formed adjacent or parallel to each other in the protecting tube at a predetermined pitch, as stated above. Further, the reinforcing member is not necessarily limited to the above-described thread- or line-shaped reinforcing member but may be a mesh-shaped reinforcing member.

According to the present invention, the filling condition of the filler in the protecting tube can be confirmed from the outside of the tube with high accuracy by virtue of the high transparency. In addition, the filler filling operation can be performed smoothly by virtue of the high pressure resistance. Therefore, the protecting tube according to the present invention is useful for being applied to bridges or the like to protect various cables. Further, according to the present invention, the ionomer resin need not be cross-linked. Therefore, it is easy to reuse the ionomer resin. With the ionomer resin, in particular, the bond strength between the metal ion component and the carboxyl groups reduces upon heating. Therefore, the adhesion between the protecting tube and the filler can be reduced by heating. Accordingly, it is also possible to improve releasability and to increase the reusability of the protecting tube.

EXAMPLES

The present invention will be described below more specifically by way of examples. It should be noted, however, that the present invention is not necessarily limited to these examples.

Example 1

An ethylene-methacrylic acid copolymer-base ionomer resin ("Himilan AM7311", available from Mitsui-DuPont Polychemical; metal ion species: Mg; MFR=0.7 g/10 min. at a temperature of 190° C. and a load of 2160 g) was extruded in the form of tape from an extruder, and the tape was spirally wound around the tubing axis. A reinforcing thread comprising a polyester fiber cord (8000 denier) was spirally wound around the tubing axis so as to be interposed between the side edge of a turn of the wound tape and the side edge of the extruded tape adjacent to the first-mentioned side edge, thereby obtaining a cable protecting tube (inner diameter: 75 mm; outer diameter: 85 mm) with a wall thickness of 2.4 mm and having the cord buried in the resin layer. It should be noted that the pitch of the protecting tube body and the pitch of the reinforcing fiber was 15 mm. A pressure test was carried out on the cable protecting tube obtained to examine the failure pressure. It was 1.4 MPa.

Comparative Example

A cable protecting tube (inner diameter; 75 mm; outer diameter: 85 mm) was obtained without using the above-described polyester fiber cord. A pressure test was carried out on the protecting tube obtained to examine the failure pressure. It was 0.8 MPa.

INDUSTRIAL APPLICABILITY

The transparent protecting tube for external cable according to the present invention is formed from an ionomer resin and is reinforced. Therefore, the protecting tube exhibits high transparency and allows the filling condition of the filler in the tube to be visually observed from the outside. Moreover, the protecting tube exhibits high pressure resistance. Therefore, it is also possible to improve the fillability of the filler and to increase the filling operation efficiency. Further, the transparent protecting tube for external cable is excellent in low-temperature resistance, flexibility and durability.

What is claimed is:

1. A protecting tube for external cable, comprising:

(a) a hollow tube, wherein the hollow tube is formed from a resin material including an ionomer resin and is transparent; and (b) at least one reinforcing member, wherein the reinforcing member is spiral or mesh-shaped and reinforces the hollow tube;

wherein the protecting tube may accommodate a tendon for prestressed concrete, can be filled with a filler and allows a filling condition of a filler in the protecting tube to be visually observed from outside of the protecting tube with accuracy.

2. The protecting tube of claim 1 wherein the reinforcing member is buried in the hollow tube.

3. The protecting tube of claim 1 wherein the protecting tube is a spirally corrugated tube or a smooth-walled tube.

4. The protecting tube of claim 1 wherein the resin material contains at least 30% by weight of an ionomer resin, and wherein the ionomer resin is one or more ethylene-unsaturated carboxylic acid copolymers, or a mixture of two or more different ethylene-unsaturated carboxylic acid copolymers, having 20% or greater of the total carboxyl groups neutralized with one or more of the same or different cations, wherein the cations are metal ions or ammonium ions.

5. A resin material for use in a transparent protecting tube for external cable comprising at least 30% by weight of an ionomer resin, wherein the ionomer resin is one or more ethylene-unsaturated carboxylic acid copolymers, or a mixture of one or more ethylene-unsaturated carboxylic acid copolymers, having 20% or greater of the total carboxyl groups neutralized with one or more of the same or different cations, wherein the cations are metal ions or ammonium ions wherein the resin material is transparent, and wherein the resin material does not contain a polyolefin in addition to the ionomer resin.

* * * * *